US007042476B2

(12) United States Patent
Wiedemer

(10) Patent No.: US 7,042,476 B2
(45) Date of Patent: May 9, 2006

(54) PRINTING DEVICE AND METHOD TO TRANSFER INK ONTO A RECORDING MEDIUM BY USE OF SPARK DISCHARGE

(75) Inventor: Manfred Wiedemer, Ismaning (DE)

(73) Assignee: Oce Printing Systems GmbH, Poing (DE)

( * ) Notice: Subject to any disclaimer, the term of this patent is extended or adjusted under 35 U.S.C. 154(b) by 219 days.

(21) Appl. No.: 10/669,283

(22) Filed: Sep. 24, 2003

(65) Prior Publication Data

US 2004/0113984 A1 Jun. 17, 2004

(30) Foreign Application Priority Data

Sep. 24, 2002 (DE) ..... 102 44 458

(51) Int. Cl.
*B41J 2/39* (2006.01)
*B41J 2/395* (2006.01)
*B41J 2/06* (2006.01)

(52) U.S. Cl. ..... 347/141; 347/55

(58) Field of Classification Search ..... 346/74; 347/51, 55, 103, 141, 154, 131
See application file for complete search history.

(56) References Cited

U.S. PATENT DOCUMENTS 3,640,214 A 2/1972 Scheinhutte
5,644,342 A 7/1997 Argyres
6,270,194 B1 8/2001 Maximovsky et al.

FOREIGN PATENT DOCUMENTS

| | | | |
|---|---|---|---|
| DE | 31 36 427 C2 | | 3/1983 |
| DE | 3136427 C2 | * | 3/1983 |
| EP | 0756544 B1 | * | 2/1997 |
| EP | 0 756 544 B1 | | 3/1998 |
| EP | 0933214 A2 | * | 4/1999 |
| EP | 0 933 214 A2 | | 8/1999 |
| WO | WO 95/29063 | | 11/1995 |
| WO | WO 01/72518 A1 | | 10/2001 |

OTHER PUBLICATIONS

Milan Mikula, et al. "the Destructive Effect of a Pulse Discharge in Water Suspension," Plasma Sources Science Technology, vol. 6, pp. 179-184.

* cited by examiner

*Primary Examiner*—Shih-Wen Hsieh
(74) *Attorney, Agent, or Firm*—Schiff Hardin LLP

(57) ABSTRACT

A printing device and a method to transfer ink onto a recording medium are disclosed. A plurality of print elements are each provided with a first high-voltage electrode and a second high-voltage electrode. Given supply of a high voltage to these electrodes, a spark discharge ensues whose shock impulse transfers ink onto the recording medium.

22 Claims, 3 Drawing Sheets

PRINTING DEVICE AND METHOD TO TRANSFER INK ONTO A RECORDING MEDIUM BY USE OF SPARK DISCHARGE

BACKGROUND OF THE INVENTION

1. Field of the Invention

The present invention generally is directed to a printing device to transfer ink onto a recording medium, and more specifically to a device to transfer on a carrier a plurality of print elements arranged in at least one linear row. Furthermore, the invention concerns a method to transfer ink onto a recording medium.

2. Description of the Related Art

From European Patent Document EP-A-0 756 544 by the same applicant, a thermoelectric printing device to transfer ink onto a recording medium is known. Print elements are arranged according to a matrix arrangement on a print drum. The surface of the print drum has pits in which are arranged heating elements that can be selectively activated. Given activation of these heating elements, ink that is contained in the pits is expelled and transferred onto the recording medium. The cited document is hereby included in the disclosure content of the present patent application by reference.

A printing device is known from Published PCT Application WO 01/72518 A1 in which print elements are likewise arranged on a carrier according to a matrix. The print elements are charged with energy with the aid of laser radiation, such that they expel ink from the surface of the carrier or from pits and transfer it onto a print medium.

A printing device is further known from U.S. Pat. No. 6,270,194 which applies ink to a carrier surface. The carrier surface is partially charged with energy with the aid of laser radiation. The arising pressure pulse causes the dissociation of ink drops that are transferred from the carrier surface to the carrier material.

The cited printing devices and printing methods have the problem that, given very small point diameters, the carrier must be charged with higher thermal energy, for example by means of a laser beam. The technical complexity (for example of providing the laser, and the appertaining optics for acoustic-optic modulators) is very high and limits the total output.

SUMMARY OF THE INVENTION

The present invention provides a printing device and a method that allow a high print speed given higher print resolution.

This is achieved by a printing device having a plurality of print elements arranged in a linear row on a carrier, each of the print elements having two high-voltage electrodes and upon supply of a high voltage to at least one print element result in a spark discharge that causes a shock impulse which transfers ink from the carrier onto the recording medium.

According to the invention, in a printing device a spark discharge is released between two of the high-voltage electrodes to transfer the ink. This developer station generates a shock impulse that transfers the ink onto the recording medium. The selective introduction of energy by a spark discharge has a favorable energy balance, i.e. a greater part of the energy is used to transfer ink; so that heating of the carrier and heating of the ink fluid is not necessary. In this manner, the time necessary for cooling is also short, and given a small carrier surface a high triggering frequency for the print elements can be realized. Furthermore, the print resolution is improved, due to the reduced thermal stress.

According to a further aspect of the invention, a method is provided to transfer ink onto a recording medium by utilizing the spark discharge. The advantages that can be achieved given this method have already been described for the printing device.

BRIEF DESCRIPTION OF THE DRAWINGS

To better understand the present invention, reference is made in the following to the preferred exemplary embodiments shown in the drawings that are specified using specific terminology. However, it is noted that the scope of protection of the invention should not thereby be narrowed, since such changes and further modifications to the shown devices and/or the methods, as well as such further applications of the invention as they are therein shown, are considered ordinary present or future knowledge of a competent average person skilled in the art.

DETAILED DESCRIPTION OF THE PREFERRED EMBODIMENTS

Figure 1:
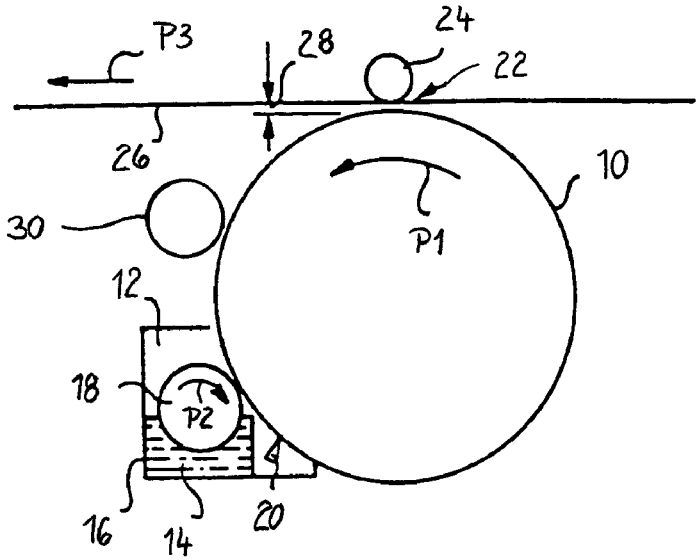
FIG. 1 is a schematic side view of an arrangement with a print roller and print elements with spark discharge.

FIG. 1 shows an arrangement in which the present invention is used. A print roller 10 rotates in the direction indicated by rotation arrow P1. A surface of the print roller 10 is inked by an inking device 12 with ink 14 from a trough 16 with the aid of an inking roller 18. The inking roller 18 rotates in the direction indicated by a rotation arrow P2. A stripping device 20, for example a scraper or a stripping ridge, sometimes referred to as a doctor blade, removes excess ink. Given further rotations of the print roller 10, the ink is supplied to a transfer printing location 22 at which a transfer printing roller 14 is arranged. A recording medium 26 is transported in the direction of transport P3 between the transfer printing roller 24 and the surface of the print roller 10 which are spaced from one another by an air gap 28. The circumferential speed of the print roller 10 and the transport speed of the recording medium 26 are substantially the same. The print elements are activated at the transfer printing location 22, as is more fully explained below. In this activation, a spark discharge arises whose shockwave transfers ink line-by-line along the surface line from the surface of the print roller 10 at the transfer printing location 22 onto the opposite surface of the recording medium 26. Given further rotation of the print roller 10, the surface arrives at a cleaning station 30 which removes ink residue from the surface of the print roller 10.

Figure 2:
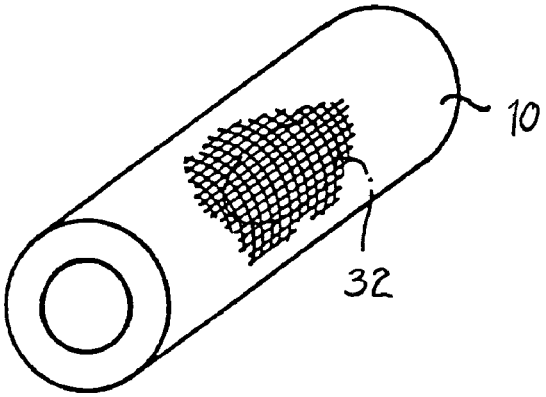
FIG. 2 is an end perspective view of a print roller with print elements arranged in the shape of a matrix.
Figure 3:
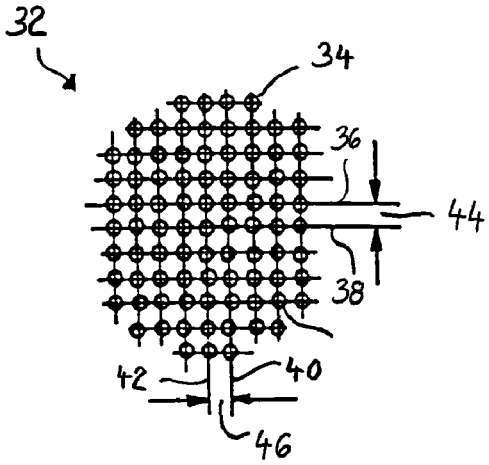
FIG. 3 is an enlarged cylindrical projection of the matrix of print elements according to FIG. 2 or in the alternative a plan view of a planar printing plate with the elements arranged as a matrix.

FIG. 2 shows a perspective view of the print roller 10. Print elements are arranged on its surface according to a matrix arrangement 32. In other words, the print elements are arranged at the intersecting points of rows and columns of a matrix. In FIG. 3, the matrix 32 is shown either as a cylindrical projection of the print elements of the print roller 10 of FIG. 2 or as a plan view of a planer printing plant having the matrix of print elements. The matrix 32 comprises a plurality of print elements 34 that respectively comprise pits in the surface of the print roller 10. Triggerable high-voltage electrodes that generate a spark discharge are provided for each print element 34. The matrix 32 is arranged in rows and columns. The separations between two rows 36, 38 and the separations between two columns 40, 42 define the resolution of the print image. Given a resolution of 240 dpi (dots per inch), the row separation 44 or, respectively, the column separation 46 is 105.8 μm. However, a print resolution of 600 dpi is preferred, meaning the row separation 44 or, respectively, the column separation 46 is 42.33 μm.

Figure 4:
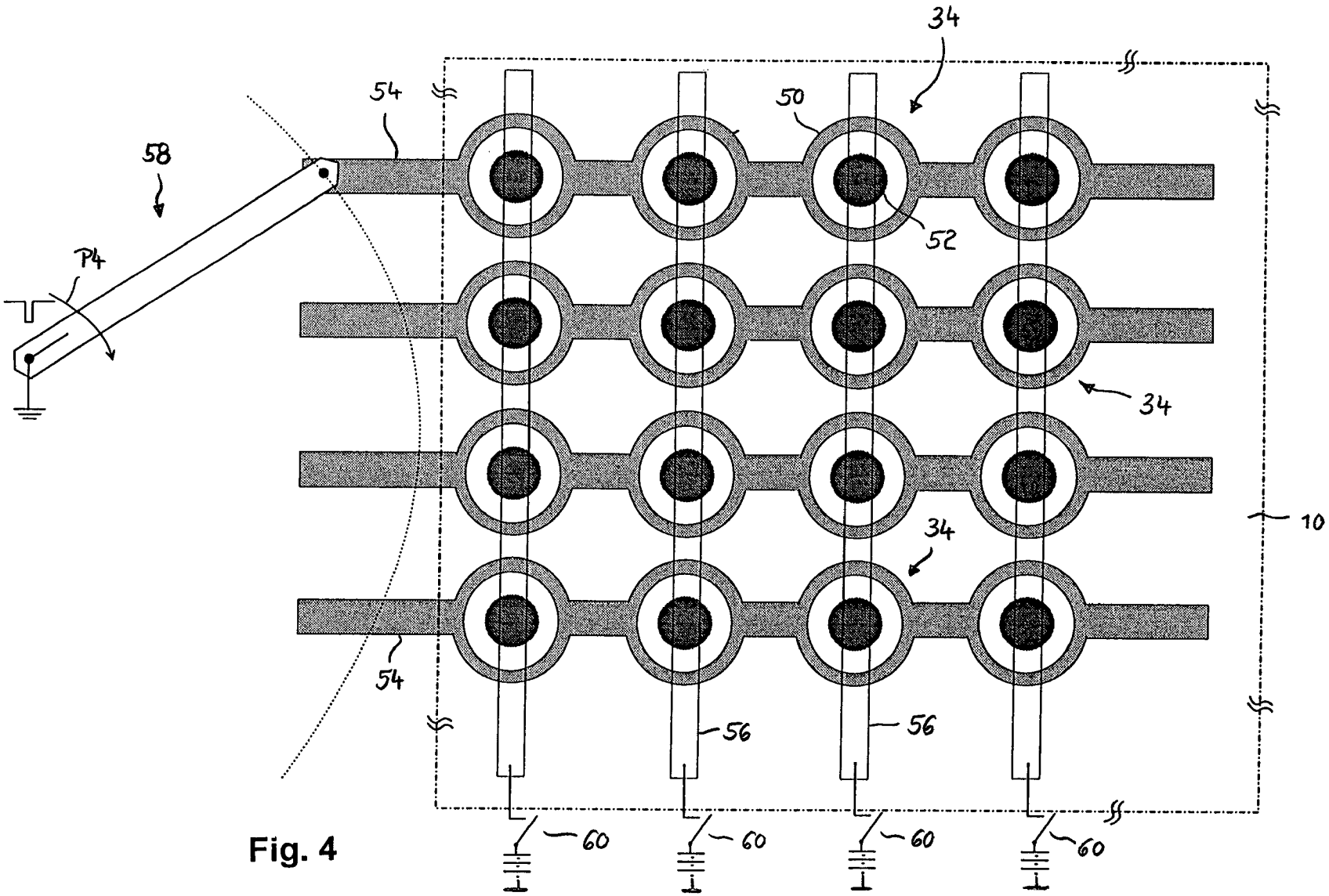
FIG. 4 is a further enlarged plan view of the arrangement of the electrodes for a matrix of print elements.

FIG. 4 shows an arrangement of the high-voltage electrodes for a plurality of print elements 34. Each print element 34 has an outer high-voltage ring electrode 50 and an approximately centrally arranged circular high-voltage electrode 52. By high voltage electrode, what is meant here is that the electrodes are capable of withstanding a high voltage differential between them. The annular high-voltage electrodes 50 of every row of print elements 34 are electrically connected with one another along a conductor path 54. The circular high-voltage electrodes 52 of the print elements 34 respectively of each column are likewise electrically connected with one another along a conductor path 56. The conductor paths 54 and the conductor paths 56 are electrically isolated from one another, likewise the annular high-voltage electrodes 50 and the circular high-voltage electrodes 52 are electrically isolated from one another.

A predetermined voltage potential is applied to the conductor path 54 of an entire row of print elements 34, as is shown schematically using the row switch 58. In a preferred embodiment, the predetermined voltage is ground potential. Of course, an electronic switch may be used as the row switch. For activation, a high-voltage potential is also applied to the conductor path 56 of a column of print elements 34. The high voltage potential of the preferred embodiment is a high positive voltage, with the result being that a high voltage differential is established between the electrodes 50 and 52.

At the cross-over point of the row conductor path 54 and the column conductor path 56, a spark discharge is released at the appertaining print element 34 when the applied high-voltage exceeds a characteristic minimum value, the sparking voltage. The spark discharge arising thereby is an independent electric discharge with only a short duration, whereby a pressure wave arises due to the shock impulse. This pressure wave affects the ink at the location of the print element 34 and induces the separation of an ink drop from the surface of the carrier 10.

The pressure wave that is produced by the spark between the electrodes 50 and 52, which may also be thought of as a sound pulse, may be optimized with respect to direction, efficiency and propagation and focusing. The high voltage or sparking potential is applied to one electrode and a zero voltage or drum potential is applied to the other electrode. The potential difference between the two causes the spark if the difference is greater than an ignition voltage or sparking voltage.

The sparking voltage is dependent on the electrical magnitudes (current, voltage and power) as well as on the physical structure (spark resistance, resistance of the ink, the inner system resistance, the discharge circuit inductivity, etc.). The energy demand, the performance of the printing unit and the viscosity of the printing ink determine the apparatus arrangement and the electrical design of the printing unit. Calculations for modeling such an energy converter may be derived from the publication, M. Mikula, J. Panak, V. Dvonka; "The Destruction Effect of a Pulse Discharge in Water Suspensions," Plasma Sources Science Technology, vol. 6, (1977), pages 179–184.

In the illustrated example, a spark discharge may be achieved with voltage differentials as low as 100 volts.

As is shown in the FIG. 4, a potential is applied with the aid of the row switch 58 at a row conductor path 54 of a row to be printed. The column conductor paths 56 are selectively switched to high-voltage potential with the aid of high-voltage switches 60, whereby image elements of an image row are printed. The switch 58 is moved along the arrow of rotation P4 to the next row conductor path 54, and the next image row is printed via selective switching of the switch 60.

The illustrated ring electrodes 50 and the circular electrodes 52 can be produced according to thick-film technology or other methods known from semiconductor technology. For example, the insulating layers between the inner circular electrode 52 and the outer ring electrode 50 can be free-etched or generated by means of a laser beam. Non-flammable materials are used as high-voltage electrodes, for example tungsten. In the case of a print roller, the contacting of the high-voltage electrodes 50, 52 can ensue from the inside of the print roller.

Figure 5:
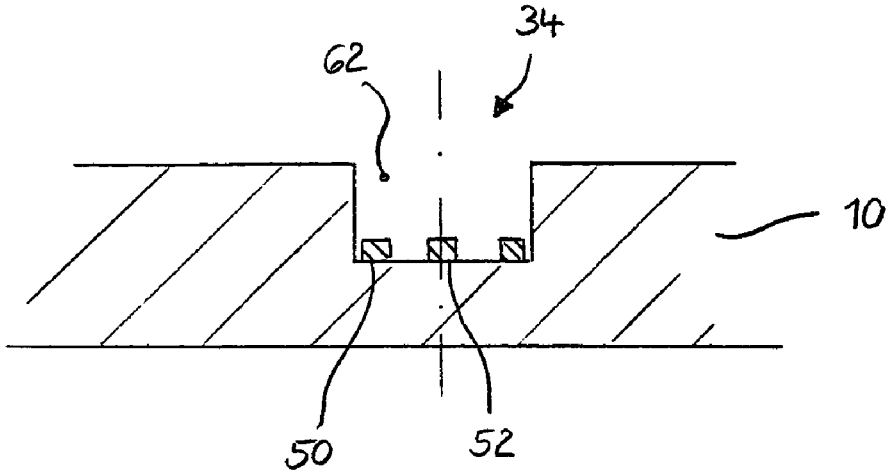
FIG. 5 is an enlarged a cross section through a print element with a pit.

FIG. 5 schematically shows a cross section through a print element 34. It comprises a cup-like pit 62 in which ink can be accepted. The pit 62 has a diameter in the range of 0.1 to 50 μm. Its diameter is dependent on the desired print resolution and may be in the range of 10 to 50 μm. Given a spark discharge between the high-voltage electrodes 50 and 52, ink is ejected from the pit 62.

Figure 6:
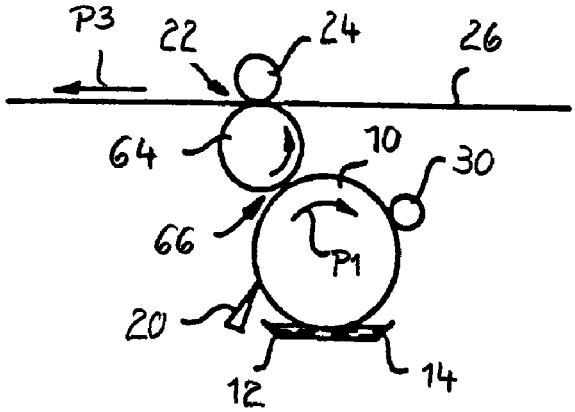
FIG. 6 is a side schematic view of an arrangement with a intermediate carrier roller between the print roller and the recording medium.

FIG. 6 shows a further arrangement similar to FIG. 1. The same parts are provided with like reference characters. In contrast to the embodiment according to FIG. 1, an intermediate carrier roller 64 is arranged on the peripheral surface of the print roller 10. The print image is transferred at the location 66 onto this intermediate carrier roller 64 and later transferred at the transfer printing location 22 onto the contacting recording medium. The intermediate carrier roller 64 has an elastic generated surface and thus generates a good contact with the recording medium 26 such that high quality printing is achieved, even given a raised surface of the recording medium 26 or given uneven surface shapes of the recording medium 26, such as for example in label printing. Furthermore, the surface of the print roller 10 is protected from contamination via the use of the intermediate carrier roller 64. Further variants of the arrangement, for example for multi-color printing, can be learned from the European Patent Document EP-A-0 756 544 by the same applicant, that is incorporated herein by reference.

Numerous variants of the specified exemplary embodiments are possible. For example, more than one pit 62, from which the ink drops are ejected due to the pressure waves generated by the spark discharge, can be associated with each print element 34. The high-voltage electrodes 50 and 52 can come directly in contact with the ink, as in the example according to FIG. 5. However, it is also possible to arrange the high-voltage electrodes 50 and 52 on the underside of the carrier 10. The shockwave generated by the spark discharge can, given a suitable material, be sufficient to eject ink from the pit 62 without the high-voltage electrodes coming in contact with this ink. Furthermore, it is also possible to do without pits altogether. The high-voltage electrodes are then arranged on the surface of the carrier and covered with a layer of ink. Given the ensuing spark discharge, drops are then transferred in the area of the high-voltage electrodes. The high-voltage electrodes can also have other geometric shapes that benefit a spark discharge, for example electrodes pointed towards one another.

As may be apparent from a review of the foregoing, properties of the ink used for the printing process may play a roll in the performance of the disclosed printing apparatus. In one embodiment, the ink has a viscosity (according to ISO 14446) from an aqueous solution from 1–3 mPa a to a highly viscous printing ink as (for example, as used in offset printing) of 10000 mPa s. The viscosity and degree of dilution are more determined by the material to be printed and the subsequent drying method than by the printing method. The print quality and desired printing performance may influence, to a relatively large extent, the selection of the printing ink and its viscosity.

The ink of a preferred embodiment has a low electrical conductivity, such as in a range of $10^{-3}$ to $10^{-18}$ Siemens/cm.

Apart from these characteristics, the ink may be as any other printing technology, and may be comprised of: pigments (color particles), binders (resins), additives (waxes, tensides, hardeners, etc.) and solvents.

Although preferred exemplary embodiments are specified shown and detailed in the drawings and in the preceding specification, this should be considered as purely exemplary, and the invention should not be considered restricted. It is to be noted that only the preferred exemplary embodiments are shown and specified, and all changes and modifications that are presently and in the future in the scope of protection of the invention should be protected.

I claim:

1. A printing device to transfer ink onto a recording medium, comprising:

a carrier;

a plurality of print elements arranged on said carrier in at least one linear row, each print element having two high-voltage electrodes; and a high-voltage supply connected to said high-voltage electrodes to selectively supply a high voltage to at least one print element so that a spark discharge ensues whose shock impulse transfers ink from said carrier onto the recording medium;

said two high-voltage electrodes of each print element including first electrodes of a first polarity and second electrodes of a second polarity, said first electrodes of said first polarity of a row of said print elements being electrically connected with one another; and said second electrodes being selectively triggered with high voltage.

2. A printing device according to claim 1, wherein said two high-voltage electrodes of said print elements includes a first electrode shaped as a ring electrode.

3. A printing device according to claim 1, wherein said two high-voltage electrodes of said print elements includes a first electrode shaped as a circular area.

4. A printing device according to claim 1, wherein said carrier defines at least one cup-like pit adapted to accept ink for each of said print elements.

5. A printing device according to claim 4, wherein said at least one cup-like pit has a diameter in the range of 10 to 50 μm.

6. A printing device according to claim 4, wherein said at least one cup-like pit has a depth of 0.1 to 50 μm.

7. A printing device according to claim 1, wherein said at least one linear row of print elements includes a plurality of rows of print elements arranged in a matrix.

8. A printing device according to claim 1, wherein said carrier is a print roller.

9. A printing device to transfer ink onto a recording medium, comprising:

a carrier:

a plurality of print elements arranged on said carrier in at least one linear row, each print element having two high-voltage electrodes;

a high-voltage supply connected to said high-voltage electrodes to selectively supply a high voltage to at least one print element so that a spark discharge ensues whose shock impulse transfers ink from said carrier onto the recording medium;

said at least one linear row of print elements including a plurality of rows of print elements arranged in a matrix;

said two high-voltage electrodes of each print element including first electrodes of a first polarity and second electrodes of a second polarity, said first electrodes of said first polarity of a row of said print elements of said matrix being electrically connected with one another;

said second electrodes of said print elements of columns of said matrix being electrically connected with one another; and given application of a high voltage at a selected row and a selected column of said matrix, a spark discharge is released at a print element located at a cross-over of said selected row and said selected column.

10. A printing device according to claim 9, wherein separation of said print elements from one another in said matrix is determined dependent on a desired print resolution.

11. A printing device to transfer ink onto a recording medium, comprising:

a carrier;

a plurality of print elements arranged on said carrier in at least one linear row; each print element having two high-voltage electrodes;

a high-voltage supply connected to said high-voltage electrodes to selectively supply a high voltage to at least one print element so that a spark discharge ensues whose shock impulse transfers ink from said carrier onto the recording medium;

said at least one linear row of print elements including a plurality of rows of print elements arranged in a matrix;

said print elements of said matrix being spaced from one another at intervals of approximately 42.33 μm.

12. A printing device to transfer ink onto a recording medium, comprising:

a carrier;

a plurality of print elements arranged on said carrier in at least one linear row, each print element having two high-voltage electrodes; and a high-voltage supply connected to said high-voltage electrodes to selectively supply a high voltage to at least one print element so that a spark discharge ensues whose shock impulse transfers ink from said carrier onto the recording medium;

said carrier being a flat plate.

13. A method to transfer ink onto a recording medium, comprising the steps of:

providing a plurality of print elements on a carrier in at least one linear row;

providing each print element with two high-voltage electrodes;

applying ink to a surface of said carrier; and selectively supplying high voltage to at least one of said print elements so that a spark discharge is released whose shock impulse transfers ink from said carrier onto the recording medium;

said plurality of print elements being disposed in a plurality of rows arranged in a matrix;

electrically connecting said high-voltage electrodes of a first polarity in said print elements of a row with one another;

electrically connecting said high-voltage electrodes of a second polarity in said print elements of a column with one another; and applying a high voltage at a selected row and at a selected column so that a spark discharge is released at a print element located at a cross-over of said selected row and said selected column.

14. A method according to claim 13, further comprising the step of:

providing at least one cup-like pit in said carrier per print element in which ink can be accepted.

15. A method according to claim 14, wherein said cup-like pit has a diameter in a range of 10 to 50 μm.

16. A method according to claim 14, wherein said cup-like pit has a depth in a range of 0.1 to 50 μm.

17. A method according to claim 13, wherein said plurality of print elements are disposed in a plurality of rows arranged in a matrix.

18. A method according to claim 13, wherein said carrier is a print roller.

19. A method according to claim 13, further comprising the step of:

transferring the ink into an intermediate carrier before transferring the ink from the intermediate carrier onto the recording medium.

20. A method to transfer ink onto a recording medium, comprising the steps of:

providing a plurality of print elements on a carrier in at least one linear row;

providing each print element with two high-voltage electrodes;

applying ink to a surface of said carrier; and selectively supplying high voltage to at least one of said print elements so that a spark discharge is released whose shock impulse transfers ink from said carrier onto the recording medium;

said plurality of print elements being disposed in a plurality of rows arranged in a matrix;

said print elements of said matrix being spaced from one another at intervals of approximately 42.3 μm.

21. A method to transfer ink onto a recording medium, comprising the steps of:

providing a plurality of print elements on a carrier in at least one linear row;

providing each print element with two high-voltage electrodes;

applying ink to a surface of said carrier; and selectively supplying high voltage to at least one of said print elements so that a spark discharge is released whose shock impulse transfers ink from said carrier onto the recording medium, said carrier being a flat plate.

22. A method to transfer ink onto a recording medium, comprising the steps of:

providing a plurality of print elements on a carrier in at least one linear row;

providing each print element with two high-voltage electrodes;

applying ink to a surface of said carrier;

selectively supplying high voltage to at least one of said print elements so that a spark discharge is released whose shock impulse transfers ink from said carrier onto the recording medium; and inking a surface of said carrier by color values.

* * * * *